US008415284B2

(12) United States Patent
Duggal

(10) Patent No.: US 8,415,284 B2
(45) Date of Patent: Apr. 9, 2013

(54) OLEFIN COPOLYMER VI IMPROVERS AND LUBRICANT COMPOSITIONS AND USES THEREOF

(75) Inventor: Akhilesh Duggal, Midlothian, VA (US)

(73) Assignee: Afton Chemical Corporation, Richmond, VA (US)

( * ) Notice: Subject to any disclaimer, the term of this patent is extended or adjusted under 35 U.S.C. 154(b) by 470 days.

(21) Appl. No.: 12/613,219

(22) Filed: Nov. 5, 2009

(65) Prior Publication Data

US 2011/0105371 A1 May 5, 2011

(51) Int. Cl.

| | |
|---|---|
| ***C10M 169/04*** | (2006.01) |
| ***C10M 143/00*** | (2006.01) |
| ***C07F 7/22*** | (2006.01) |
| ***C08F 8/00*** | (2006.01) |

(52) U.S. Cl. ..... 508/591; 508/287; 508/391; 508/460; 508/469; 508/501; 525/55; 585/10; 585/11; 585/12

(58) Field of Classification Search ..... 508/287, 508/591, 391, 460, 539, 382, 501; 525/55
See application file for complete search history.

(56) References Cited

U.S. PATENT DOCUMENTS

| | | | | |
|---|---|---|---|---|
| 3,087,936 | A | 4/1963 | LeSuer | |
| 3,172,892 | A | 3/1965 | LeSuer et al. | |
| 3,185,704 | A | 5/1965 | Kahn et al. | |
| 3,215,707 | A | 11/1965 | Rense | |
| 3,231,587 | A | 1/1966 | Rense | |
| 3,254,025 | A | 5/1966 | LeSuer | |
| 3,272,746 | A | 9/1966 | LeSuer | |
| 3,275,554 | A | 9/1966 | Hendrick | |
| 3,366,569 | A | 1/1968 | Norman et al. | |
| 3,373,111 | A | 3/1968 | LeSuer et al. | |
| 3,381,022 | A | 4/1968 | LeSuer | |
| 3,442,808 | A | 5/1969 | Traise et al. | |
| 3,509,055 | A | 4/1970 | Bauer | |
| 3,565,804 | A | 2/1971 | Honnen et al. | |
| 4,026,809 | A | 5/1977 | Lachowicz et al. | |
| 4,085,055 | A | 4/1978 | Durand et al. | |
| 4,110,349 | A | 8/1978 | Cohen | |
| 4,146,489 | A | 3/1979 | Stambaugh et al. | |
| 4,152,499 | A | 5/1979 | Boerzel et al. | |
| 4,160,739 | A | 7/1979 | Stambaugh et al. | |
| 4,161,452 | A * | 7/1979 | Stambaugh et al. | 508/233 |
| 4,234,435 | A | 11/1980 | Meinhardt et al. | |
| 4,388,202 | A | 6/1983 | Nagano et al. | |
| 4,579,675 | A | 4/1986 | Sawicki et al. | |
| 4,611,031 | A | 9/1986 | Galluccio et al. | |
| 4,612,132 | A | 9/1986 | Wallenberg et al. | |
| 4,636,322 | A | 1/1987 | Nalesnik | |
| 4,661,549 | A | 4/1987 | Walker | |
| 4,663,064 | A | 5/1987 | Nalesnik et al. | |
| 4,677,151 | A | 6/1987 | Pennewiss et al. | |
| 4,686,054 | A | 8/1987 | Wisotsky et al. | |
| 4,826,613 | A | 5/1989 | Hart et al. | |
| 4,839,071 | A | 6/1989 | Guteirrez et al. | |
| 4,839,072 | A | 6/1989 | Guteirrez et al. | |
| 4,863,623 | A | 9/1989 | Nalesnik | |
| 4,867,890 | A | 9/1989 | Colclough et al. | |
| 4,908,411 | A | 3/1990 | Kinoshita et al. | |
| 4,943,672 | A | 7/1990 | Hamner et al. | |
| 5,075,383 | A | 12/1991 | Migdal et al. | |
| 5,093,418 | A | 3/1992 | Kinoshita et al. | |
| 5,140,074 | A | 8/1992 | DeNicola, Jr. et al. | |
| 5,334,321 | A | 8/1994 | Harrison et al. | |
| 5,356,552 | A | 10/1994 | Harrison et al. | |
| 5,397,842 | A * | 3/1995 | Hamilton et al. | 525/263 |
| 5,716,912 | A | 2/1998 | Harrison et al. | |
| 5,777,025 | A | 7/1998 | Spencer et al. | |
| 5,837,773 | A | 11/1998 | Oliver et al. | |
| 5,849,676 | A | 12/1998 | Harrison et al. | |
| 5,861,363 | A | 1/1999 | Willis, Jr. et al. | |
| 5,874,389 | A | 2/1999 | Boden et al. | |
| 5,891,953 | A | 4/1999 | Spencer et al. | |
| 6,013,171 | A | 1/2000 | Cook et al. | |
| 6,080,301 | A | 6/2000 | Berlowitz et al. | |
| 6,096,940 | A | 8/2000 | Wittenbrink et al. | |
| 6,103,099 | A | 8/2000 | Wittenbrink et al. | |
| 6,107,257 | A | 8/2000 | Valcho et al. | |
| 6,110,880 | A | 8/2000 | Verstrate et al. | |
| 6,153,565 | A | 11/2000 | Skinner et al. | |
| 6,165,949 | A | 12/2000 | Berlowitz et al. | |
| 6,180,575 | B1 | 1/2001 | Nipe | |
| 6,281,179 | B1 | 8/2001 | Skinner et al. | |
| 6,429,178 | B1 | 8/2002 | Skinner et al. | |
| 6,429,179 | B1 | 8/2002 | Skinner et al. | |
| 6,525,007 | B2 | 2/2003 | Okada et al. | |
| 6,764,985 | B2 | 7/2004 | Okada et al. | |
| 7,253,231 | B2 | 8/2007 | Devlin et al. | |
| 7,402,235 | B2 | 7/2008 | Huang | |
| 7,429,555 | B2 | 9/2008 | Scherer et al. | |
| 2003/0216509 | A1 * | 11/2003 | Goethel et al. | 525/70 |
| 2004/0038850 | A1 * | 2/2004 | Huang | 510/475 |
| 2006/0264342 | A1 * | 11/2006 | Shaw et al. | 508/460 |
| 2007/0249508 | A1 | 10/2007 | Matsuda et al. | |
| 2008/0026972 | A1 * | 1/2008 | Mathur et al. | 508/545 |
| 2009/0312208 | A1 | 12/2009 | Ishikawa et al. | |
| 2009/0312210 | A1 | 12/2009 | Grisso et al. | |

FOREIGN PATENT DOCUMENTS

| | | |
|---|---|---|
| CA | 1335895 | 6/1995 |
| EP | 382450 | 8/1990 |
| EP | 1795580 A1 | 6/2007 |
| JP | 06346078 | 12/1994 |
| JP | 2006008840 | 1/2006 |
| JP | 2006008841 | 1/2006 |

* cited by examiner

*Primary Examiner* — Ellen McAvoy
*Assistant Examiner* — Vishal Vasisth
(74) *Attorney, Agent, or Firm* — Luedeka Neely Group, P.C.

(57) ABSTRACT

A lubricating oil composition and methods of operating an internal combustion engine to provide improved engine operation. The lubricating composition includes a major amount of oil of lubricating viscosity and a minor amount of at least one olefin copolymer having a number average molecular weight greater than about 10,000 up to about 300,000. The olefin copolymer is grafted with (A) a vinyl-substituted aromatic compound, and (B) a compound selected from the group consisting of a $C_5$-$C_{30}$ olefin, a polyalkylene compound, and mixtures thereof. A mole ratio of A/B in the reaction mixture ranges from about 0.25:1 to about 5:1. The lubricating composition optionally includes a minor amount of at least one non-grafted olefin copolymer, styrene-isoprene copolymer, methacrylate copolymer, or styrene butadiene copolymer have number average molecular weight greater than about 50,000 up to about 300,000.

23 Claims, No Drawings

OLEFIN COPOLYMER VI IMPROVERS AND LUBRICANT COMPOSITIONS AND USES THEREOF

TECHNICAL FIELD

The disclosure relates to lubrication oil compositions and additives for internal combustion engines and to methods of operating the engines with the compositions to provide improved engine performance.

BACKGROUND AND SUMMARY

The viscosity of lubricating oils is typically dependent on temperature. With an increase in oil temperature, the viscosity of the oil generally decreases; as the temperature of the oil decreases, the viscosity of the oil generally increases. At high temperatures where modern engines typically operate, it is important to maintain viscosity within specified ranges to properly lubricate moving parts of the engine. Additionally, the lubricating oils may be exposed to low temperatures from the environment when the engines are shut off; in these conditions, the viscosity of the oil must be low enough so that the oil will flow when under engine starting conditions. The acceptable oil viscosity ranges for high and low temperatures are specified by the SAE J300 standard.

Lubricating oils also encounter high shear rates while being used in engines. Shear rates as high as $10^6\ s^{-1}$ have been reported in literature. The viscosity behavior of lubricants under high temperature, high shear (HTHS) conditions may have an impact on fuel economy. Fluids with relatively high HTHS viscosities typically exhibit poor fuel economy due to the formation of a thicker oil film at the boundary of the engine surfaces. By contrast, fluids with relatively low HTHS viscosities may form a thinner film thickness thereby exhibiting improved fuel economy.

Base oils typically cannot meet the viscosity requirements without the addition of additives such as viscosity index improvers. Viscosity index improvers (VII's) reduce the extent to which the viscosity of lubricants change with temperature, and are used to formulate oils that meet the SAE J300 standard. Suitable Viscosity Index Improvers are polymeric materials that may be derived from ethylene-proplyene copolymers, polymethacrylates, hydrogenated styrene-butadiene copolymers, polyisobutylenes, etc.

Ethylene-propylene copolymers are typically used to provide Viscosity Index Improvers for engine oils. The ethylene content of such copolymers may range from 45 to 85 mole %. Viscosity Index Improvers derived from polymers containing about 60 mole % ethylene are commonly used and require a relatively higher usage or treat rate in oils in order to meet SAE J300 requirements; however, Viscosity Index Improves derived from polymers containing higher than about 65 mole % ethylene to 85 mole % ethylene generally require lower usage or treat rate in oils in order to meet SAE J300 requirements.

The high ethylene polymers, e.g., ethylene contents of 65 mole % to 85 mole % ethylene, are used to improve low temperature properties of lubricating oils. Without being bound by theory, it is believed that at low temperatures, polymers with high ethylene content are thought to undergo intramolecular contraction or folding, leading to a lower viscosity of the oil, when compared to a low ethylene (~60 mole %) amorphous polymers that do not exhibit such behavior. As a result of such polymer behavior, low temperature properties, such as CCS (cold crank simulator) viscosity, are improved. However, a high ethylene polymer chain may also interact with other chains, or with waxy components that are contained in the oil composition, leading to gel formation. Gel formation is undesirable, as it causes a lack of lubricating oil circulating to the engine, which may lead to engine failures. To prevent the inter-molecular interactions or polymer-waxy component interactions, high levels of pour point depressant may be added to the oil. Higher levels of pour point depressants serve to mitigate but not completely solve the problem.

Accordingly, there is a need to provide viscosity modifiers for lubricant compositions that enable the lubricant compositions to meet the SAE J300 standards while providing lubricant compositions that exhibit improved fuel economy, low temperature properties, and gelation-free behavior.

In accordance with exemplary embodiments, the disclosure provides a lubricating oil composition and methods of operating an internal combustion engine to provide improved engine operational performance. The lubricating composition includes a major amount of oil of lubricating viscosity; a minor amount of at least one olefin copolymer having a number average molecular weight greater than about 10,000 up to about 300,000. The olefin copolymer is grafted with (A) a vinyl-substituted aromatic compound, and (B) a compound selected from the group consisting of a $C_5$-$C_{30}$ olefin, an internal olefin, a polyalkylene compound, and combinations thereof, wherein a mole ratio of AB in the reaction mixture ranges from about 0.25:1 to about 5:1. The lubricating oil composition may optionally include a minor amount of at least one non-grafted olefin copolymer, styrene-isoprene copolymer, methacrylate copolymer, or styrene butadiene copolymer have number average molecular weight greater than about 50,000 up to about 300,000.

In another exemplary embodiment, the disclosure provides an olefin copolymer viscosity index improver. The olefin copolymer is an extruder reaction product of (a) an olefin copolymer backbone having a number average molecular weight ranging from greater than about 10,000 to about 300,000; and (b) a grafting component including a vinyl-substituted aromatic compound and a grafting component selected from $C_5$-$C_{30}$ alpha olefins, internal olefins, polyisoalkylenes, and combinations thereof.

Another exemplary embodiment provides an extruded non-dispersant olefin copolymer that is a reaction product of (a) an olefin copolymer, wherein the copolymer has a number average molecular weight ranging from greater than about 10,000 to about 300,000; and (b) a grafting component substantially devoid of carboxylic functionalizing groups including (A) a vinyl-substituted aromatic compound and (B) a component selected from the group consisting of $C_5$-$C_{30}$ alpha olefins, internal olefins, polyisoalkylenes, and mixtures thereof.

Yet another exemplary embodiment of the disclosure provides a method for improving fuel economy in a vehicle. The method includes lubricating an engine of the vehicle with a lubricant composition including a major amount of oil of lubricating viscosity; and a minor amount of at least one olefin copolymer having a number average molecular weight greater than about 10,000 up to about 300,000. The olefin copolymer is grafted with about 1 to about 30 weight percent of a combination of (A) a vinyl-substituted aromatic compound, and (B) a component selected from a $C_5$-$C_{30}$ olefin, an internal olefin, a polyisoalkylene, and mixtures thereof. The lubricating oil composition may optionally include a minor amount of at least one non-grafted olefin copolymer, styrene-isoprene copolymer, methacrylate copolymer, or styrene butadiene copolymer have number average molecular weight greater than about 50,000 up to about 300,000.

Accordingly, a primary advantage of the exemplary embodiments may be improved low temperature properties without forming gels at high temperatures. Another advantage may be reduced need for pour point depressants in lubricant compositions containing the grafted olefin copolymers described herein. Yet another advantage of embodiments of the disclosure may be greater fuel economy.

DETAILED DESCRIPTION OF EXEMPLARY EMBODIMENTS

As described in more detail below, the disclosure is directed to improved grafted olefin copolymer viscosity index improvers (VII's) having improved high and low temperature properties. The olefin copolymer VII's described herein may be used in a variety of applications including, but not limited to, engine lubrication, transmission oils, and industrial oils.

A primary substrate for making the VII's described herein is a copolymer is derived from ethylene monomer and one or more $C_3$ to $C_{23}$ alpha-olefin monomers. Copolymers of ethylene and propylene are suitably used to make the copolymer. "Copolymers" herein may include without limitation blends or reacted products of ethylene and one or more $C_3$ to $C_{23}$ alpha-olefins. The copolymers may optionally include dienes or polyenes. Thus, the terms "polymers" and "copolymers", as used herein may also include terpolymers, and other higher polymer forms. Hence the terms "polymer" and "copolymer" are used generically to encompass ethylene copolymers, terpolymers or interpolymers. Such materials may contain amounts of other olefinic monomers so long as the basic characteristics of the polymers are not materially changed.

Other alpha-olefins suitable for use in place of propylene to form the copolymer or to be used in combination with ethylene and propylene to form a terpolymer include 1-butene, 1-pentene, 1-hexene, 1-octene and styrene; α,ω-diolefins such as 1,5-hexadiene, 1,6-heptadiene, 1,7-octadiene; branched chain alpha-olefins such as 4-methylbutene-1,5-methylpentene-1 and 6-methylheptene-1; and mixtures thereof.

Methods for making the copolymer substrate described above are described, e.g., in U.S. Pat. Nos. 4,863,623, 5,075,383, and 6,107,257, which descriptions are incorporated herein by reference. The polymer substrate also may be commercially obtained having the properties indicated herein.

More complex polymer substrates, often designated as interpolymers, also may be used as the olefin polymer starting material, which may be prepared using a third component. The third component generally used to prepare an interpolymer substrate is a polyene monomer selected from nonconjugated dienes and trienes. The-non-conjugated diene component is one having from 5 to 14 carbon atoms in the chain. For example, the diene monomer may be characterized by the presence of a vinyl group in its structure and can include cyclic and bicyclo compounds. Representative dienes include 1,4-hexadiene, 1,4-cyclohexadiene, dicyclopentadiene, 5-ethylidene-2-norbornene, vinylnorbornene, 5-methylene-2-norborene, 1,5-heptadiene, and 1,6-octadiene. A mixture of more than one diene may be used in the preparation of the interpolymer. A suitable nonconjugated diene for preparing a terpolymer or interpolymer substrate is 1,4-hexadiene.

The triene component may have at least two nonconjugated double bonds, and up to about 30 carbon atoms in the chain. Typical trienes that may be used to prepare the interpolymer are 1-isopropylidene-3α,4,7,7α-tetrahydroindene, 1-isopropylidene-dicyclopentadiene, dihydro-isodicyclopentadiene, and 2-(2-methylene-4methyl-3-pentenyl)[2.2.1]bicyclo-5-heptene.

Ethylene-propylene or higher alpha-olefin copolymers may consist of from about 15 to 85 mole percent ethylene and from about 85 to 15 mole percent $C_3$ to $C_{23}$ alpha-olefin with the mole ratios in one embodiment being from about 40 to 70 mole percent ethylene and from about 60 to 30 mole percent of a $C_3$ to $C_{23}$ alpha-olefin, with the proportions in another embodiment being from 60 to 85 mole percent ethylene and 40 to 15 mole percent $C_3$ to $C_{23}$ alpha-olefin, and the proportions in yet another embodiment being from 55 to 65 mole percent ethylene and 45 to 35 mole percent $C_3$ to $C_{23}$ alpha-olefin. Terpolymer variations of the foregoing polymers may contain from about 0 to 10 mole percent of a nonconjugated diene or triene. Other termonomer levels are less than 1 mole percent.

Of the foregoing, a particularly suitable copolymer substrate is a substantially linear copolymer of ethylene and propylene having an ethylene content ranging from about 60 to about 85 percent by weight and having a number average molecular weight from about 10,000 to about 300,000, and for example a number average molecular weight of 100,000 to 200,000, as determined by gel permeation chromatography utilizing polystyrene standards.

The polymer described above, i.e., the olefin copolymer substrate, may be conveniently obtained in the form of ground or pelletized polymer. The olefin copolymer may also be supplied as either a pre-mixed bale or a pre-mixed friable chopped agglomerate form.

In one embodiment, ground polymer bales or other forms of the olefin copolymer are fed to an extruder, e.g., a single or twin screw extruder, or a Banbury or other mixer having the capability of heating and effecting the desired level of mechanical work (agitation) on the polymer substrate for the dehydration step. A nitrogen blanket can be maintained at the feed section of the extruder to minimize the introduction of air.

The olefin copolymer may initially be heated before being admixed with any other reactants in the extruder or other mixer with venting to eliminate moisture content in the feed material. The dried olefin copolymer is in one embodiment then fed into another extruder section or separate extruder in series for conducting the grafting reaction.

A mixture of graft components is next grafted onto the polymer backbone of the olefin copolymer. Suitable graft components may be selected from vinyl aromatic compounds, $C_5$-$C_{30}$ olefins, and polyalkylene. Suitable vinyl aromatic compounds are those corresponding to the following formula

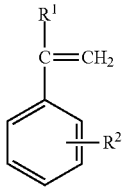

wherein $R^1$ and $R^2$, independently from each other, represent a hydrogen atom or an alkyl group having 1 to 4 carbon atoms. Specific examples include, but are not limited to styrene, o-vinyltoluene, m-vinyltoluene, p-vinyltoluene, m-isopropylstyrene, p-isopropylstyrene, alpha-methylstyrene, o-methyl-alpha-methylstyrene, m-methyl-alpha-methylstyrene, p-methyl-alpha-methylstyrene, m-isopropyl-alpha-methylstyrene, and p-isopropyl-alpha-methylstyrene.

The olefin compounds that may be used are primarily $C_5$-$C_{30}$ linear or branched olefins having internal or terminal unsaturation. A particularly suitable olefin component to be grafted to the copolymer backbone is a substantially linear, alpha olefin having at least about 90 mole percent terminal olefins comprised of at least 95 mole percent of $C_{10}$-$C_{18}$ olefins.

The polyalkylene component may be selected from polybutenes and highly reactive polybutenes having a number average molecular weight ranging from about 400 to about 3000 or more. The term "highly reactive" means that a number of residual vinylidene double bonds in the compound is greater than about 45%. For example, the number of residual vinylidene double bonds may range from about 50 to about 85% in the compound. The percentage of residual vinylidene double bonds in the compound may be determined by well-known methods, such as for example Infra-Red Spectroscopy or C13 Nuclear Magnetic Resonance or a combination thereof. A process for producing such compounds is described, for example, in U.S. Pat. No. 4,152,499. A particularly suitable compound is a polyisobutene having a ratio of weight average molecular weight to number average molecular weight ranging from about 1 to about 6 and a number average molecular weight ranging from about 500 to about 1500.

The mixture of grafting components includes at least one component selected from (A) vinyl aromatic compounds and at least one component selected from (B) olefins and/or polyakylene compounds wherein a mole ratio of A/B in the mixture ranges from about 0.25:1 to about 5.0:1, for example, from about 0.5:1 to about 2.5:1, more suitably from about 0.75:1 to about 1.5:1. The amount of grafting components (e.g., vinyl aromatic compound, olefin and/or polyisoalkylene) that are grafted onto the prescribed copolymer backbone (i.e., the copolymer substrate) is important. For example, the copolymer may include from about 1 wt % to 30 wt % of the grafting components.

The grafting reaction to form the grafted olefin copolymers is generally carried out with the aid of a free-radical initiator in bulk in an extruder in the substantial absence of solvent. The free-radical initiators which may be used to graft the component to the polymer backbone include peroxides, hydroperoxides, peresters, and also azo compounds and preferably those which decompose thermally within the grafting temperature range to provide free radicals. Representatives of these free-radical initiators are azobutyronitrile, dicumyl peroxide, 2,5-dimethyl-2,5-di(t-butylperoxy)hexane and 2,5-dimethyl-2,5-di(t-butylperoxy)-3-hexyne. The initiator may be used in an amount ranging from about 0.005% to about 2% by weight based on the weight of the reaction mixture, desirably from about 0.2% to about 1% by weight.

To perform the grafting reaction as a solvent-free or essentially solvent-free bulk process, the graft component, olefin copolymer, and initiator are in one embodiment fed to an extruder, e.g., a single or twin screw extruder or other mixer, having the capability of heating and effecting the desired level of mechanical work (agitation) on the reactants for the grafting step. The initiator may be added as a solution in the grafting components or an inert solvent, such as but not limited to mineral oil. In one embodiment, grafting is conducted in an extruder, and particularly a twin screw extruder. A nitrogen blanket is maintained at the feed section of the extruder to minimize the introduction of air. The extruder is equipped with a vent to facilitate removal of unreacted grafting components and by-products of the grafting reaction.

In another embodiment, the grafting components may be injected at one injection point, or is alternatively injected at two injection points in a zone of the extruder without significant mixing e.g. a transport zone. Such injection may result in an improved efficiency of the grafting and may lead to a lower gel content of the grafted copolymer.

Suitable extruders are generally known available for conducting grafting, and the prior dehydration procedure. The dehydration of the polymer substrate and subsequent grafting procedures may be performed in separate extruders set up in series. Alternatively, a single extruder having multiple treatment or reaction zones may be used to sequentially conduct the separate operations within one piece of equipment. Illustrations of suitable extruders are set forth, e.g., in U.S. Pat. No. 3,862,265 and U.S. Pat. No. 5,837,773, which descriptions are incorporated herein by reference.

In forming the grafted olefin copolymers, the olefin copolymer generally is fed to plastic processing equipment such as an extruder, intensive mixer or masticator, heated to a temperature of at least 60°, for example, 150° to 240° C., and the grafting components and free-radical initiator are separately fed to the molten copolymer to effect grafting. In another embodiment, all three of the grafting components, copolymer and initiator may be fed to the extruder at substantially the same time. The reaction is carried out optionally with mixing conditions sufficient to effect grafting of the olefin copolymers. If molecular weight reduction and grafting are performed simultaneously, illustrative mixing conditions are described in U.S. Pat. No. 5,075,383, which are incorporated herein by reference. The processing equipment is generally purged with nitrogen to prevent oxidation of the copolymer. The processing equipment is equipped with a vent in order to facilitate removal of unreacted reagents and byproducts of the grafting reaction. The residence time in the processing equipment is controlled to provide for the desired degree of grafting and to allow for purification of the grafted copolymer via venting. Mineral or synthetic lubricating oil may optionally be added to the processing equipment after the venting stage to dissolve the grafted copolymer.

The grafted copolymer exits from the die face of the extruder either immediately after grafting, or after shearing and vacuum stripping (discussed below in more detail) if performed in different sections of the same extruder or a separate extruder arranged in series with the extruder in which grafting is conducted.

The grafting reaction may also be carried out in the presence of a hydrocarbon solvent. Hydrocarbon solvents that may be used include open-chain aliphatic compounds such as $C_9$ or lower alkanes, alkenes and alkynes (e.g., $C_5$ to $C_8$ alkanes such as hexane); aromatic hydrocarbons (e.g., compounds having a benzene nucleus such as benzene and toluene); alicyclic hydrocarbons such as saturated cyclic hydrocarbons (e.g., cyclohexane); ketones; or any combinations of these. Solvent grafting may be conducted in a pressurized (above atmospheric pressure) reactor or a series of pressurized reactors.

The molecular weight of the grafted olefin copolymer may be reduced by mechanical, thermal, or chemical means, or a combination thereof. Techniques for degrading or reducing the molecular weight of such copolymers are generally known in the art. The number average molecular weight is reduced to suitable level for use in single grade or multigrade lubricating oils.

In one embodiment, the grafted copolymer has an initial number average molecular weight ranging from about 10,000 to about 500,000 upon completion of the grafting reaction. In one embodiment, to prepare an additive intended for use in multigrade oils, the copolymer's number average molecular weight is reduced down to a range of about 100,000 to about 200,000 as measured by gel permeation chromatography using polystyrene calibration standards.

Alternatively, grafting and reduction of the high molecular weight olefin copolymer may be done simultaneously. In another alternative, the high molecular weight olefin copolymer may be first reduced to the prescribed molecular weight before grafting. When the olefin copolymer's average molecular weight is reduced before grafting, its number average molecular weight is sufficiently reduced to a value below about 250,000, e.g., in the range of about 100,000 to 200,000.

Reduction of the molecular weight of the olefin copolymer feed material during or prior to grafting, to a prescribed lower molecular weight typically is conducted in the absence of a solvent or in the presence of a base oil, using either mechanical, thermal, or chemical means, or combination of these means. Generally, the olefin copolymer, is heated to a molten condition at a temperature in the range of about 200° C. to about 350° C. and it is then subjected to mechanical shear, thermally or chemical induced cleavage or combination of said means, until the copolymer intermediate (or olefin copolymer) is reduced to the prescribed molecular weight. The shearing may be effected within an extruder section, such as described, e.g., in U.S. Pat. No. 5,837,773, which descriptions are incorporated herein by reference. Alternatively, mechanical shearing may be conducted by forcing the molten copolymer through fine orifices under pressure or by other mechanical means.

Upon completion of the grafting reaction, grafting components and free radical initiator usually are removed and separated from the grafted copolymer product. The unreacted components may be eliminated from the reaction mass by vacuum stripping, e.g., the reaction mass may be heated to temperature of about 150° C. to about 450° C. under agitation with a vacuum applied for a period sufficient to remove the volatile unreacted grafting component and free radical initiator ingredients. Vacuum stripping may be performed in an extruder section equipped with venting means.

The grafted copolymer may be formed into pellets by a variety of process methods commonly practiced in the art of plastics processing. Such techniques include underwater pelletization, ribbon or strand pelletization or conveyor belt cooling. When the strength of the copolymer is inadequate to form into strands, the preferred method is underwater pelletization. Temperatures during pelletization should not exceed 30° C. Optionally, a surfactant may be added to the cooling water during pelletization to prevent pellet agglomeration.

The mixture of water and quenched copolymer pellets is conveyed to a dryer such as a centrifugal drier for removal of water. Pellets may be collected in a box or plastic bag at any volume for storage and shipment. Under some conditions of storage and/or shipment at ambient conditions, pellets may tend to agglomerate and stick together. The pellets may be ground by mechanical methods to provide high surface area solid pieces for easy and quick dissolution into oil.

The grafted olefin copolymers of the present disclosure may be incorporated into lubricating oil in any convenient way. Thus, the grafted olefin copolymers may be added directly to the lubricating oil by dispersing or dissolving the same in the lubricating oil at the desired level of concentration. Such blending into the lubricating oil may occur at room temperature or elevated temperatures. Alternatively, the grafted olefin copolymers may be blended with a suitable solvent/diluent (such as, lubricating base oils and petroleum distillates) to form a concentrate, and then blending the concentrate with a lubricating oil to obtain the final formulation. Such additive concentrates will typically contain (on an active ingredient (A.I.) basis) from about 3 to about 25 wt. %, for example, from about 5 to about 15 wt. %, grafted olefin copolymer additive, and typically from about 75 to 97 wt %, and suitably from about 85 to 95 wt %, base oil based on the concentrate weight.

Lubricating oil formulations for internal combustion engines as described herein may conventionally contain additional additives that will supply the characteristics that are required in the formulations. Among these types of additives are included additional viscosity index improvers, antioxidants, corrosion inhibitors, detergents, dispersants, pour point depressants, antiwear agents, antifoaming agents, demulsifiers and friction modifiers. These additives are provided in what is commonly called a dispersant/inhibitor (DI) package.

One component of the DI package is a metal-containing or ash-forming detergent that functions as both a detergent to reduce or remove deposits and as an acid neutralizer or rust inhibitors, thereby reducing wear and corrosion and extending engine life. Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., barium, sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from 20 to 450, neutral and overbased calcium phenates and sulfurized phenates having TBN of from 50 to 450 and neutral and overbased magnesium or calcium salicylates having a TBN of from 20 to 450. Combinations of detergents, whether overbased or neutral or both, may be used. In one preferred lubricating oil composition.

Detergents generally useful in the formulation of lubricating oil compositions also include "hybrid" detergents formed with mixed surfactant systems, e.g., phenate/salicylates, sulfonate/phenates, sulfonate/salicylates, sulfonates/phenates/salicylates, as described, for example, in U.S. Pat. Nos. 6,153,565, 6,281,179, 6,429,178 and 6,429,179.

Dispersants maintain in suspension materials resulting from oxidation during use that are insoluble in oil, thus preventing sludge flocculation and precipitation, or deposition on metal parts. Dispersants useful in the context of the disclosure include the range of nitrogen-containing, ashless (metal-free) dispersants known to be effective to reduce formation of deposits upon use in gasoline and diesel engines, when added to lubricating oils.

Processes for reacting polymeric hydrocarbons with unsaturated carboxylic acids, anhydrides or esters and the preparation of derivatives from such compounds are disclosed in U.S. Pat. Nos. 3,087,936; 3,172,892; 3,215,707; 3,231,587; 3,272,746; 3,275,554; 3,381,022; 3,442,808; 3,565,804; 3,912,764; 4,110,349; 4,234,435; 5,777,025; 5,891,953; as well as EP 0 382 450 B1; and CA-1,335,895.

A suitable dispersant composition is one comprising at least one polyalkenyl succinimide, which is the reaction product of a polyalkenyl substituted succinic anhydride (e.g., PIBSA) and a polyamine (PAM) that has a coupling ratio of from about 0.65 to about 1.5, for example, from about 0.8 to about 1.1, and desirably from about 0.9 to about 1. In the context of this disclosure, "coupling ratio" may be defined as a ratio of the number of succinyl groups in the PIBSA to the number of primary amine groups in the polyamine reactant.

Another class of high molecular weight ashless dispersants comprises Mannich base condensation products. Generally, these products are prepared by condensing about one mole of a long chain alkyl-substituted mono- or polyhydroxy benzene with about 1 to 2.5 moles of carbonyl compound(s) (e.g., formaldehyde and paraformaldehyde) and about 0.5 to 2 moles of polyalkylene polyamine, as disclosed, for example, in U.S. Pat. No. 3,442,808. Such Mannich base condensation products may include a polymer product of a metallocene catalyzed polymerization as a substituent on the benzene group, or may be reacted with a compound containing such a polymer substituted on a succinic anhydride in a manner similar to that described in U.S. Pat. No. 3,442,808. Other suitable dispersants are described in U.S. Pat. Nos. 4,839,071; 4,839,072; 4,579,675; 3,185,704; 3,373,111; 3,366,569; 4,636,322; 4,663,064; 4,612,132; 5,334,321; 5,356,552; 5,716,912; 5,849,676; 5,861,363; 4,686,054; 3,254,025; 3,087,936. The foregoing list is not exhaustive and other methods of capping nitrogen-containing dispersants are known to those skilled in the art.

Additional additives may be incorporated into the compositions of the disclosure to enable particular performance requirements to be met. Examples of additives which may be included in the lubricating oil compositions of the present disclosure are metal rust inhibitors, viscosity index improvers, corrosion inhibitors, oxidation inhibitors, friction modifiers, anti-foaming agents, anti-wear agents and pour point depressants. Some are discussed in further detail below.

Dihydrocarbyl dithiophosphate metal salts are frequently used as antiwear and antioxidant agents. The metal may be an alkali or alkaline earth metal, or aluminum, lead, tin, molybdenum, manganese, nickel or copper. The zinc salts are most commonly used in lubricating oil in amounts of 0.1 to 10, preferably 0.2 to 2 wt. %, based upon the total weight of the lubricating oil composition.

Particularly desirable zinc salt include zinc dihydrocarbyl dithiophosphates that may be represented by the following formula:

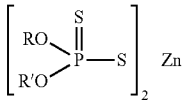

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals.

Oxidation inhibitors or antioxidants reduce the tendency of mineral oils to deteriorate in service. Oxidative deterioration can be evidenced by sludge in the lubricant, varnish-like deposits on the metal surfaces, and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, oil soluble phenates and sulfurized phenates, phosphosulfurized or sulfurized hydrocarbons or esters, phosphorous esters, metal thiocarbamates, oil soluble copper compounds as described in U.S. Pat. No. 4,867,890, and molybdenum-containing compounds.

Aromatic amines having at least two aromatic groups attached directly to the nitrogen constitute another class of compounds that is frequently used for antioxidancy. While these materials may be used in small amounts, preferred embodiments of the present disclosure are free of these compounds. When used, the amount of aromatic amines may range from about 0.1 to about 1.5 percent by weight of the total weight of the lubricating oil composition. A particularly useful amount of aromatic amines may be from about 0.4 wt. % or more based on the total weight of the lubricating oil composition.

Representative examples of suitable viscosity modifiers are polyisobutylene, copolymers of ethylene and propylene, polymethacrylates, methacrylate copolymers, copolymers of an unsaturated dicarboxylic acid and a vinyl compound, interpolymers of styrene and acrylic esters, and partially hydrogenated copolymers of styrene/isoprene, styrene/butadiene, and isoprene/butadiene, as well as the partially hydrogenated homopolymers of butadiene and isoprene.

Friction modifiers and fuel economy agents that are compatible with the other ingredients of the final oil may also be included. Examples of such materials include glyceryl mono- and di-esters of higher fatty acids, for example, glyceryl mono-oleate; esters of long chain polycarboxylic acids with diols, for example, the butane diol ester of a dimerized unsaturated fatty acid; fatty-acid imides; oxazoline compounds; and alkoxylated alkyl-substituted mono-amines, diamines and alkyl ether amines, for example, ethoxylated tallow amine and ethoxylated tallow ether amine.

Other known friction modifiers comprise oil-soluble metallic compounds such as organo-molybdenum compounds, organo-titanium compounds and organo-tungsten compounds. Such organo-metallic friction modifiers may also provide antioxidant and antiwear credits to a lubricating oil composition. As an example of such oil soluble organo-metallic compounds, there may be mentioned the carboxylates, dithiocarbamates, dithiophosphates, dithiophosphinates, xanthates, thioxanthates, sulfides, and the like, and mixtures thereof. Particularly useful organo-metallic compounds include molybdenum dithiocarbamates, dialkyldithiophosphates, alkyl xanthates, and alkylthioxanthates. Other organo-metallic compounds may include the oil soluble titanium and tungsten carboxylates.

The terms "oil-soluble" or "dispersible" used herein do not necessarily indicate that the compounds or additives are soluble, dissolvable, miscible, or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

Pour point depressants, otherwise known as lube oil flow improvers (LOFI), lower the minimum temperature at which the fluid will flow or can be poured. Such additives are well known. Typical of those additives that improve the low temperature fluidity of the fluid are $C_8$ to $C_{18}$ dialkyl fumarate/vinyl acetate copolymers, polymethacrylates, and maleic anhydride-styrene copolymers esterified with $C_8$ to $C_{20}$ alcohols. Foam control may be provided by an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and need not be further elaborated herein.

When lubricating compositions contain one or more of the above-mentioned additives comprising the DI package, each additive is typically blended into the base oil in an amount that enables the additive to provide its desired function. Representative effective amounts of such additives, when used in crankcase lubricants, are listed below. All the values listed are stated as mass percent active ingredient.

TABLE 1

| Additive | Mass % (Broad) | Mass % (Typical) |
|---|---|---|
| Metal Detergents | 0.1 to 15.0 | 0.29 to 9.0 |
| Dispersants | 0.1 to 10.0 | 1.0 to 6.0 |
| Corrosion Inhibitor | 0 to 5.0 | 0 to 1.5 |
| Metal Dihydrocarbyl Dithiophosphate | 0 to 6.0 | 0.1 to 4.0 |
| Antioxidant | 0 to 5.0 | 0.01 to 2.0 |
| Pour Point Depressant | 0.01 to 5.0 | 0.01 to 1.5 |
| Antifoaming Agent | 0 to 5.0 | 0.001 to 0.15 |
| Supplemental Antiwear Agents | 0 to 1.0 | 0 to 0.5 |
| Friction Modifiers | 0 to 5.0 | 0 to 1.5 |
| Viscosity Modifier | 0.01 to 10.0 | 0.25 to 3.0 |
| Basestock | Balance | Balance |

In the preparation of lubricating oil formulations it is common practice to introduce the additives in the form of 10 to 80 wt. % active ingredient concentrates in hydrocarbon oil, e.g. mineral lubricating oil, or other suitable solvent.

Usually these concentrates may be diluted with 3 to 100, e.g., 5 to 40, parts by weight of lubricating oil per part by weight of the additive package in forming finished lubricants, e.g. crankcase motor oils. The purpose of concentrates, of course, is to make the handling of the various materials less difficult and awkward as well as to facilitate solution or dispersion in the final blend. Thus, the grafted olefin copolymer would usually be employed in the form of a 5 to 15 wt. % concentrate, for example, in a lubricating oil fraction. In one embodiment, the amount of concentrate in a finished lubricating oil is from about 0.05 weight percent to about 15 weight percent of the total lubricating oil.

The grafted olefin copolymers of the present disclosure will generally be used in admixture with a lube oil base stock, comprising an oil of lubricating viscosity, including natural lubricating oils, synthetic lubricating oils and mixtures thereof.

Hence, the base oil used which may be used as described herein may be selected from any of the base oils in Groups I-V as specified in the American Petroleum Institute (API) Base Oil Interchangeability Guidelines. Such base oil groups are as follows:

TABLE 2

| Base Oil Group[1] | Sulfur (wt %) | | Saturates (wt %) | Viscosity Index |
|---|---|---|---|---|
| Group I | >0.03 | And/or | <90 | 80 to 120 |
| Group II | ≦0.03 | And | ≧90 | 80 to 120 |
| Group III | ≦0.03 | And | ≧90 | ≧120 |
| Group IV | all polyalphaolefins (PAOs) | | | |
| Group V | all others not included in Groups I-IV | | | |

[1]Groups I-III are mineral oil base stocks.

The base oil may also contain a minor or major amount of a poly-alpha-olefin (PAO). Typically, the poly-alpha-olefins are derived from monomers having from about 4 to about 30, or from about 4 to about 20, or from about 6 to about 16 carbon atoms. Examples of useful PAOs include those derived from octene, decene, mixtures thereof, and the like. PAOs may have a viscosity of from about 2 to about 15, or from about 3 to about 12, or from about 4 to about 8 cSt at 100° C. Examples of PAOs include 4 cSt at 100° C. poly-alpha-olefins, 6 cSt at 100° C. poly-alpha-olefins, and mixtures thereof. Mixtures of mineral oil with the foregoing poly-alpha-olefins may be used.

The base oil may be an oil derived from Fischer-Tropsch synthesized hydrocarbons. Fischer-Tropsch synthesized hydrocarbons are made from synthesis gas containing $H_2$ and CO using a Fischer-Tropsch catalyst. Such hydrocarbons typically require further processing in order to be useful as the base oil. For example, the hydrocarbons may be hydroisomerized using processes disclosed in U.S. Pat. No. 6,103,099 or U.S. Pat. No. 6,180,575; hydrocracked and hydroisomerized using processes disclosed in U.S. Pat. No. 4,943,672 or U.S. Pat. No. 6,096,940; dewaxed using processes disclosed in U.S. Pat. No. 5,882,505; or hydroisomerized and dewaxed using processes disclosed in U.S. Pat. No. 6,013,171; U.S. Pat. No. 6,080,301; or U.S. Pat. No. 6,165,949.

Unrefined, refined, and rerefined oils, either natural or synthetic (as well as mixtures of two or more of any of these) of the type disclosed hereinabove may be used in the base oils. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives, contaminants, and oil breakdown products.

The base oil may be combined with an additive composition as disclosed in embodiments herein to provide a crankcase lubricant composition. Accordingly, the base oil may be present in the crankcase lubricant composition in an amount ranging from about 50 wt % to about 95 wt % based on a total weight of the lubricant composition.

Among other advantages, the grafted olefin copolymers, described herein, have been observed to provide improved high and low temperature properties in lubricant formulations. These properties include kinematic viscosity (KV), cold crank simulator (CCS) viscosity, mini-rotary viscometer viscosity (MRV-TP1), High Temperature High Shear Viscosity, Shear Stability Index, and Temperature Cycled Gelation (TCG). Kinematic viscosity (KV) may be measured as described in ASTM D-445. Measurement of Cold Cranking Simulator (CCS) viscosity is described in ASTM D-5293. MRV-TP1 may be measured as described in ASTM D4684. High Temperature High Shear (HTHS) Viscosity may be measured as described in ASTM D4683/D5481. Shear Stability Index may be measured as described in ASTM D6278. Temperature Cycled Gelation (TCG) may be measured by placing the oil in a temperature cycling chamber, where temperature is varied from high to low temperature over a time period. Oil is observed at the low temperature condition; if no gels are observed it passes the test; if gels are observed, it fails the test.

The HTHS viscosity of lubricant compositions containing the grafted copolymers described herein may provide an indication of the fuel economy performance of the lubricant composition. Under high shear rates, polymers experience what is termed as temporary shear by elongating in the shear field. As polymers are coiled up in oils, stearic hinderance may prevent the polymers from uncoiling and aligning with the shear field in the engine. Polymers having such stearic hinderance may cause the oil to form a thicker oil film at the boundary of the engine surfaces; a thicker oil film is known to take up more energy in movement which may lead to lower fuel economy. Fluids with relatively low HTHS viscosity provide a lower film thickness and thus may provide better fuel economy.

EXAMPLES

In the following examples (1-10), an ethylene-propylene copolymer containing 80 mole % ethylene was fed to a twin screw extruder. Monomers and 2,5-dimethyl-2,5-di(t-butylperoxy)-3-hexyne catalyst were metered into the extruder at the wt % shown in Table 3. The processing temperature in the extruder was controlled to between about 180-230° C. The resulting grafted polymer was recovered at the end of the extruder through a die and cooled underwater. The grafted polymers of examples 1-10 were dissolved in a Group II 110 N base oil at 6 wt % polymer in the base oil. The viscosity at 100° C. of the polymer solution was measured by ASTM D445. The molecular weight of the samples was measured by gel permeation technology using polystyrene standards. These results are shown in Table 4.

TABLE 3

| Sample | Base Polymer | Monomer 1 | Monomer 2 | Monomer 1 wt % | Monomer 2 wt % | Catalyst wt % |
|---|---|---|---|---|---|---|
| 1 | 80 Mole % Ethylene-Propylene Copolymer | C10/C12/C14 Alpha Olefin | Styrene | 10 | 6.18 | 0.24 |
| 2 | | C10/C12/C14 Alpha Olefin | Styrene | 10 | 6.18 | 0.48 |
| 3 | | C10/C12/C14 Alpha Olefin | Styrene | 20 | 12.36 | 0.48 |
| 4 | | C10/C12/C14 Alpha Olefin | Styrene | 20 | 12.36 | 0.96 |
| 5 | | C10 Alpha Olefin | Styrene | 15 | 11.13 | 0.43 |
| 6 | | C10 Alpha Olefin | Styrene | 15 | 11.13 | 0.86 |
| 7 | | C16 Alpha Olefin | Styrene | 15 | 6.95 | 0.27 |
| 8 | | C16 Alpha Olefin | Styrene | 15 | 6.95 | 0.54 |

TABLE 3-continued

| Sample | Base Polymer | Monomer 1 | Monomer 2 | Monomer 1 wt % | Monomer 2 wt % | Catalyst wt % |
|---|---|---|---|---|---|---|
| 9 | | None | Styrene | 0 | 10.00 | 0.39 |
| 10 | | None | Styrene | 0 | 10.00 | 0.78 |

TABLE 4

| Sample | Viscosity, cSt at 100° C. | GPC Mw | GPC Mn |
|---|---|---|---|
| 1 | 1130 | 330704 | 206953 |
| 2 | 925 | 299709 | 185569 |
| 3 | 1012 | 306588 | 150765 |
| 4 | 562 | 238432 | 124232 |
| 5 | 997 | 259022 | 110050 |
| 6 | 586 | 179463 | 108209 |
| 7 | 1130 | 318837 | 167503 |
| 8 | 870 | 287800 | 179883 |
| 9 | 837 | 206792 | 65936 |
| 10 | 550 | 156514 | 97725 |

The following three polymers were used as comparative examples to demonstrate improvements of the present invention. Comparative sample A was a 60 mole % ethylene-propylene non-grafted copolymer that was dissolved in a Group II 110N oil at 7.7 wt %. Comparative sample B was a 80 mole % ethylene-propylene non-grafted copolymer that was dissolved in a Group II 110N oil at 6.5 wt. %. Comparative sample C was the same base polymer used in the preparation of Invention Examples 1-10. Sample C was processed through the extruder under the same conditions as examples 1-10, but no monomers or catalyst were added to this sample. Comparative sample C was dissolved in a Group II 110N oil at 6 wt %.

The polymer solutions of the samples of Table 3 and the three comparative polymers solutions were used to formulate SAE 5W-30 oils. The oils contained 10% of a dispersant inhibitor package, 0.2-0.3% of a pour point depressant. The polymer solution was adjusted to a treat rate to obtain a kinematic viscosity of about 10.9 cSt, and the remainder was a mixture of Motiva Star 5 and Star 6 oils in a 87.71/12.29 ratio. The oils were evaluated for Kinematic Viscosity at 100° C., CCS at −30° C., MRV-TP-1 at −35° C., High Temperature High Shear (HTHS) at 150° C. and the Temperature Cycled Gelation (TCG) test.

The result of the evaluations of the samples A, B, C and 1-10 are shown in Table 5. The active polymer required to formulate the oils at equal viscosity was much lower for the polymers according to the disclosure (Samples 1-10). The CCS viscosities of Samples (1-10) were 466-1024 cP better than the comparative sample A. The MRV viscosities of the Samples 1-10 were also much improved over the comparative sample A. The HTHS of the Samples 1-10 showed a reduction over the HTHS of all comparative samples, indicating an improvement in fuel economy of an engine operating with these oils. The temperature cycled gelation of the Samples 1-10 were improved over the comparative sample B and C, both of which are 80 mole % ethylene-propylene copolymers, and were known to be crystalline materials prone to gelation. However, careful selection of the grafting monomers and their charge levels, as well as of the catalyst level, was required in order to pass the temperature cycled gelation evaluation. Thus it can be concluded that the polymers according to the disclosure lower the treat rate, improve CCS, MRV, HTHS and TCG performance of the SAE 5W-30 oils.

TABLE 5

| Sample | Wt % Polymer Solution | Wt % Active Polymer | KV, cSt at 100° C. | CCS, cP at −30° C. | MRV, cP at −35° C. | MRV, Yield Stress | HTHS, cP at 150° C. | TCG |
|---|---|---|---|---|---|---|---|---|
| A | 8.28 | 0.639 | 10.91 | 6241 | 26513 | 0 | 3.10 | Pass |
| B | 10.45 | 0.68 | 10.62 | N/A | 26944 | 10 | N/A | Fail |
| C | 11.09 | 0.666 | 10.89 | 5912 | 16812 | 0 | 3.02 | Fail |
| 1 | 8.90 | 0.534 | 10.93 | 5349 | 19093 | 0 | 2.77 | Fail |
| 2 | 9.15 | 0.549 | 10.94 | 5775 | 19569 | 0 | 2.71 | Fail |
| 3 | 9.00 | 0.540 | 10.92 | 5775 | 17725 | 0 | 2.72 | Pass |
| 4 | 10.31 | 0.619 | 10.92 | 5724 | 17142 | 0 | 2.66 | Pass |
| 5 | 9.03 | 0.542 | 10.94 | 5684 | 18778 | 0 | 2.75 | Pass |
| 6 | 10.20 | 0.612 | 10.88 | 5686 | 18707 | 0 | 2.67 | Pass |
| 7 | 8.98 | 0.539 | 10.95 | 5217 | 17031 | 0 | 2.72 | Pass |
| 8 | 9.35 | 0.561 | 10.87 | 5743 | 19021 | 0 | 2.64 | Pass |
| 9 | 9.50 | 0.570 | 10.97 | 5735 | 16440 | 0 | 2.67 | Pass |
| 10 | 10.69 | 0.642 | 10.90 | 5749 | 15755 | 0 | 2.6 | Pass |

The polymer solutions of samples of Table 3 and the three comparative polymers solutions were used to formulate SAE 10W-40 oils. The oils contained 10% of a dispersant inhibitor package, 0.2-0.5% of a pour point depressant. The polymer solution were adjusted to a treat rate to obtain a kinematic viscosity of about 15.5 cSt, and the remainder was a mixture of Motiva Star 4 and Star 6 oils in a 28.44/710.56 ratio. The oils were evaluated for Kinematic Viscosity at 100° C., CCS at −25° C., MRV-TP-1 at −30° C., High Temperature High Shear (HTHS) at 150° C. and the Temperature Cycled Gelation (TCG) test. The results of these evaluations are shown in Table 6.

The active polymer required to formulate the oils at equal viscosity was much lower for the polymers of Samples 1-10 than for Samples A, B, and C. The CCS viscosities of Samples 1-10 were 400-795 cP better than for comparative sample A. The MRV viscosities of the Samples 1-10 was also much improved over comparative sample A. The HTHS of the Samples 1-10 showed a significant reduction over the HTHS of all the comparative samples A, B, and C, indicating an improvement in fuel economy of an engine operating with the oils of Samples 1-10. The temperature cycled gelation of the Samples 1-10 was improved over the comparative sample B and C, both of which were 80 mole % ethylene-propylene copolymers, and were known to be crystalline materials prone to gelation. However, careful selection of the grafting monomers and their charge levels, as well as of the catalyst level, was required in order to pass the temperature cycled gelation evaluation. Thus it can be concluded that the polymers of Samples 1-10 lowered the treat rate, improved CCS, MRV, HTHS and TCG performance of the SAE 5W-30 oils.

TABLE 6

| Sample | Wt % Polymer Solution | Wt % Active Polymer | KV, cSt at 100° C. | CCS, cP at −25° C. | MRV, cP at −30° C. | MRV, Yield Stress | HTHS, cP at 150° C. | TCG |
|---|---|---|---|---|---|---|---|---|
| A | 11.88 | 0.917 | 15.52 | 6189 | 30274 | 0 | 3.92 | Pass |
| B | 15.89 | 1.03 | 16.00 | N/A | 53698 | 30 | N/A | Fail |
| C | 15.12 | 0.907 | 15.47 | 5604 | 20320 | 0 | 3.85 | Fail |
| 1 | 11.95 | 0.717 | 15.51 | 5482 | 19440 | 0 | 3.47 | Fail |
| 2 | 12.50 | 0.750 | 15.48 | 5586 | 19181 | 0 | 3.34 | Fail |
| 3 | 12.14 | 0.729 | 15.46 | 5788 | 17245 | 0 | 3.28 | Pass |
| 4 | 14.08 | 0.845 | 15.57 | 5725 | 16789 | 0 | 3.21 | Pass |
| 5 | 12.14 | 0.729 | 15.46 | 5785 | 17101 | 0 | 3.35 | Fail |
| 6 | 13.67 | 0.820 | 15.52 | 5530 | 17059 | 0 | 3.22 | Pass |
| 7 | 11.99 | 0.719 | 15.46 | 5394 | 16933 | 0 | 3.37 | Pass |
| 8 | 12.58 | 0.755 | 15.52 | 5483 | 15755 | 0 | 3.23 | Pass |
| 9 | 12.94 | 0.776 | 15.45 | 5575 | 18577 | 0 | 3.29 | Fail |
| 10 | 14.51 | 0.870 | 15.45 | 5538 | 17423 | 0 | 3.17 | Pass |

As mentioned above, careful selection of the monomer chain length, its treat level and catalyst charge amount may be required in order to ensure that lubricating oils prepared with the grafted polymers of the disclosed embodiments pass the temperature cycled gelation (TCG) evaluation test. In general, higher levels of alpha-olefins are more effective, longer alpha olefins are more effective, and higher catalyst levels (which result in increased incorporation of the alpha olefin on the polymer) are more effective for preparing grafted copolymers that pass the TCG test. A person skilled in the art may appreciate that increasing the foregoing levels may come at a cost and may have conflict with other performance requirements, and may therefore select the appropriate graft monomer, level and catalyst level needed to pass the TCG test.

It may also be appreciated that lubricating oils containing higher levels of active polymer may require more graft monomers, longer chain graft monomers and higher catalyst levels. As an example for lighter oils, such as 5W30 oils (Table 4, sample 3-8), where the levels of the active polymer were lower (about 0.5 wt. %), a minimum of 15 wt. % alpha-olefin of C10 or higher chain length was required to pass the TCG test. However, for more viscous 10W40 oils (Table 6, samples 3-8), 15 wt. % or higher of a C10 alpha olefin is sufficient, but higher catalyst levels were required to pass the TCG test. Similarly, it can be seen from Table 5, samples 9-10 and Table 6, sample 10 that styrene alone enabled passage of the TCG test. However, in a case where more polymer was present in the lubricating oils (10W40 oil, Table 5, sample 9) additional catalyst levels were needed to incorporate more monomer onto the polymer backbone.

A person skilled in the art may appreciate that the wax content of base oils may also have an effect on the monomer level, chain length of monomer, and catalyst level necessary to pass the TCG test. This is because more waxy base oils may have a greater propensity for interaction with polymer chains. Therefore, the skilled person may use an appropriate graft monomer, level and catalyst level to counteract such interaction and pass the TCG tests.

In the following Samples 11-14, an ethylene-propylene copolymer containing 60 mole % ethylene was fed to a twin screw extruder. Monomers and 2,5-dimethyl-2,5-di(t-butylperoxy)-3-hexyne catalyst were metered into the extruder at the wt % shown in Table 7. The processing temperature in the extruder was controlled to between about 180-230° C. The resulting grafted polymer was recovered at the end of the extruder through a die and cooled underwater.

The grafted polymers of Samples 11-14 were dissolved in a Group II 110 N base oil at 8 wt % polymer in the base oil. The viscosities at 100° C. of these polymer solutions were measured by ASTM D445. The molecular weight of the samples was measured by gel permeation technology using polystyrene standards. These results are shown in Table 7.

TABLE 7

| Sample | Base Polymer | Monomer 1 | Monomer 2 | Monomer 1 wt % | Monomer 2 wt % | Catalyst wt % |
|---|---|---|---|---|---|---|
| 11 | 60 mole % | C10/C12/C14 | Styrene | 10 | 6.18 | 0.24 |
| 12 | ethylene- | Alpha | | 10 | 6.18 | 0.48 |
| 13 | propylene | Olefin | | 15 | 9.27 | 0.36 |
| 14 | copolymer | | | 15 | 9.27 | 0.72 |

TABLE 8

| | Viscosity, cSt | GPC | | |
|---|---|---|---|---|
| Sample | at 100° C. | Mw | Mn | Pd |
| 11 | 2063 | 349649 | 195647 | 1.8 |
| 12 | 1348 | 308647 | 166081 | 1.9 |
| 13 | 1681 | 340985 | 182133 | 1.9 |
| 14 | 1425 | 312701 | 166967 | 1.9 |

The polymer solutions of the samples of Table 8 and the ungrafted comparative base polymer solutions were used to formulate SAE 5W-30 oils. The oils contained 10% of a dispersant inhibitor package, 0.2-0.3% of a pour point depressant. The polymer solution was adjusted to a treat rate to obtain a kinematic viscosity of about 10.9 cSt, and the remainder was a mixture of Motiva Star 5 and Star 6 oils in a 87.71/12.29 ratio. The oils were evaluated for Kinematic Viscosity at 100° C., CCS at −30° C., MRV-TP-1 at −35° C., High Temperature High Shear (HTHS) at 150° C. and the Temperature Cycled Gelation (TCG) test. The results of these evaluations are shown in Table 9.

The active polymer required to formulate the oils at equal viscosity was much lower for the polymers of Samples 11-14 than for the base polymer. The HTHS of Samples 11-14 showed significant reduction over the HTHS of all comparative samples, indicating an improvement in fuel economy of an engine operating with these oils. Thus it can be concluded that the polymers of Samples 11-14 lowered the treat rate and HTHS performance of the SAE 5W-30 oils. From the results of Samples 1-14, it was demonstrated that the polymers according to the disclosure were capable of producing engine oils with low HTHS, and improved fuel economy, regardless of the ethylene content of the polymer backbone.

TABLE 9

| Sample | Wt % Polymer Solution | Wt % Active Polymer | KV, cSt at 100° C. | CCS, cP at −30° C. | MRV, cP at −35° C. | MRV, Yield Stress | HTHS, cP at 150° C. |
|---|---|---|---|---|---|---|---|
| A | 8.28 | 0.639 | 10.91 | 6241 | 26513 | 0 | 3.10 |
| 11 | 7.12 | 0.569 | 10.88 | 6529 | 42289 | 0 | 2.79 |
| 12 | 7.60 | 0.608 | 10.90 | 6526 | 36837 | 0 | 2.73 |
| 13 | 7.33 | 0.586 | 10.87 | 6411 | 42713 | 0 | 2.76 |
| 14 | 7.49 | 0.599 | 10.88 | 6492 | 40650 | 0 | 2.67 |

The SAE J300 standard specifies a 2.90 cP minimum HTHS for 5W30 oils. It is recognized that the oils made with the polymer of Samples 11-14 have a HTHS lower than this minimum. In order to make oils conforming to the SAE J300 HTHS minimum, a mixture of grafted and ungrafted polymers may be used. For example, a 75/25 mixture of the polymer of Sample 11 and Sample A may be used to produce a 5W-30 oil with a HTHS of 2.9 cP.

It is generally believed that conventional copolymers with high ethylene content may have relatively high polymer efficiency and better CCS viscosities than the same copolymers having lower ethylene content. However, such conventional high ethylene copolymers typically require higher pour point treatment amounts in lubricating oils in order to avoid gelation. By comparison, the grafted copolymers of the disclosure may provide better CCS viscosities and MRV at lower pour point treatment rates and may also improve fuel economy as indicated by the HTHS viscosities of the lubricant compositions containing the grafted copolymers.

The disclosures of all patents, articles and other materials described herein are hereby incorporated, in their entirety, into this specification by reference. Compositions described as "comprising" a plurality of defined components are to be construed as including compositions formed by admixing the defined plurality of defined components. The principles, preferred embodiments and modes of operation of the present disclosure have been described in the foregoing specification. What applicants submit, however, is not to be construed as limited to the particular embodiments disclosed, since the disclosed embodiments are regarded as illustrative rather than limiting. Changes may be made by those skilled in the art without departing from the spirit of the disclosed embodiments.

What is claimed is:

1. A lubricating oil composition comprising:

a major amount of oil of lubricating viscosity; and a minor amount of at least one olefin copolymer having a number average molecular weight greater than about 10,000 up to about 300,000, wherein the olefin copolymer is grafted with a grafting component substantially devoid of carboxylic functionalizing groups comprising (A) a vinyl-substituted aromatic compound, and (B) a compound selected from the group consisting of a $C_5$-$C_{30}$ olefin, a polyalkylene compound, and mixtures thereof, wherein a mole ratio of A/B in the reaction mixture ranges from about 0.25:1 to about 5:1; and optionally, a minor amount of at least one non-grafted olefin copolymer, styrene-isoprene copolymer, methacrylate copolymer, or styrene butadiene copolymer have number average molecular weight greater than about 50,000 up to about 300,000, wherein the olefin copolymer has an ethylene content ranging from about 60 to about 85 mole percent of the olefin copolymer.

2. The lubricating oil composition of claim 1, wherein the grafted olefin copolymer and non-grafted olefin copolymer comprise copolymers of ethylene and one or more $C_3$-$C_{23}$ alpha olefins.

3. The lubricating oil composition of claim 1, further comprising a dispersant/inhibitor package comprising a dispersant, a metal-containing detergent, an antiwear agent, an antioxidant, and a friction modifier.

4. The lubricating oil composition of claim 3, wherein the detergent is selected from the group consisting of neutral and overbased calcium sulfonate, neutral and overbased magnesium sulfonate, neutral and overbased calcium phenate, calcium salicylate, magnesium salicylate, and mixtures thereof.

5. The lubricating oil composition of claim 3, wherein the dispersant comprises one or more polyalkenyl succinimide dispersants.

6. The lubricating oil composition of claim 3, wherein the friction modifier is selected from the group consisting of non-metal containing organic friction modifiers, organometallic friction modifiers, and mixtures thereof.

7. The lubricating oil composition of claim 6, wherein the organometallic friction modifier is selected from the group consisting of oil soluble organo-titanium, oil soluble organo-molybdenum compounds, and oil soluble organo-tungsten compounds.

8. The lubricating oil composition of claim 6, wherein the non-metal containing friction modifier is selected from the group consisting of glycerol monooleate, and nitrogen containing friction modifiers.

9. The lubricating oil composition of claim 1, wherein the grafted olefin copolymer is derived from a mixture of (A) vinyl aromatic compounds and (B) $C_5$-$C_{30}$ olefins wherein a mole ratio of A/B may range from about 0.5:1 to about 2.5:1.

10. An olefin copolymer viscosity index improver comprising an extruder reaction product of:

(a) an olefin copolymer backbone, wherein the copolymer has a number average molecular weight ranging from greater than about 10,000 to about 300,000; and (b) a grafting component substantially devoid of carboxylic functionalizing groups comprising (A) a vinyl-substituted aromatic compound and (B) a component selected from the group consisting of $C_5$-$C_{30}$ alpha olefins, internal olefins, polyisoalkylenes, and combinations thereof, wherein the olefin copolymer has an ethylene content ranging from about 60 to about 85 mole percent of the olefin copolymer.

11. The olefin copolymer of claim 10, wherein the olefin copolymer comprises a copolymer of ethylene and one or more $C_3$-$C_{23}$ alpha olefins.

12. The olefin copolymer of claim 11, wherein the grafting component has a mole ratio of A/B ranging from about 0.25:1 to about 5:1.

13. A method for improving fuel economy in a vehicle, comprising lubricating an engine of the vehicle with a lubricant composition comprising:

a major amount of oil of lubricating viscosity; and a minor amount of at least one olefin copolymer having a number average molecular weight greater than about 10,000 up to about 300,000, wherein the olefin copolymer is grafted with a grafting component substantially devoid of carboxylic functionalizing groups comprising from about 1 to about 30 weight percent of (A) a vinyl-substituted aromatic compound, and (B) a compound selected from the group consisting of a $C_5$-$C_{30}$ olefin, a polyalkylene compound, and mixtures thereof; and optionally, a minor amount of at least one non-grafted olefin copolymer, styrene-isoprene copolymer, methacrylate copolymer, or styrene butadiene copolymer have number average molecular weight greater than about 50,000 up to about 300,000, wherein the olefin copolymer has an ethylene content ranging from about 60 to about 85 mole percent of the olefin copolymer.

14. The method of claim 13, wherein the grafted olefin copolymer and non-grafted olefin copolymer comprise copolymers of ethylene and one or more $C_3$-$C_{23}$ alpha olefins.

15. The method of claim 13, wherein the lubricant composition comprises a dispersant/inhibitor package comprising a dispersant, a metal-containing detergent, an antiwear agent, an antioxidant, and a friction modifier.

16. The method of claim 15, wherein the detergent is selected from the group consisting of neutral and overbased calcium sulfonate, neutral and overbased magnesium sulfonate, neutral and overbased calcium phenate, calcium salicylate, magnesium salicylate, and mixtures thereof.

17. The method of claim 15, wherein the dispersant comprises one or more polyalkenyl succinimide dispersants.

18. The method of claim 15, wherein the friction modifier is selected from the group consisting of non-metal containing organic friction modifiers, organometallic friction modifiers, and mixtures thereof.

19. The method of claim 13, wherein the grafted olefin copolymer copolymer is derived from a mixture of (A) vinyl aromatic compounds and (B) $C_5$-$C_{30}$ olefins wherein a mole ratio of A/B may range from about 0.5:1 to about 2.5:1.

20. The method of claim 13, wherein the lubricant composition comprises less than 0.5 weight percent pour point depressant based on the total weight of the lubricant composition.

21. An extruded non-dispersant olefin copolymer comprising a reaction product of:

(a) an olefin copolymer, wherein the copolymer has a number average molecular weight ranging from greater than about 10,000 to about 300,000; and (b) a grafting component substantially devoid of carboxylic functionalizing groups comprising (A) a vinyl-substituted aromatic compound and (B) a component selected from the group consisting of $C_5$-$C_{30}$ alpha olefins, internal olefins, polyisoalkylenes, and mixtures thereof, wherein the olefin copolymer has an ethylene content ranging from about 60 to about 85 mole percent of the olefin copolymer.

22. The olefin copolymer of claim 21, wherein the olefin copolymer comprises a copolymer of ethylene and one or more $C_3$-$C_{23}$ alpha olefins.

23. The olefin copolymer of claim 22, wherein the grafting component has a mole ratio of A/B ranging from about 0.25:1 to about 5:1.

* * * * *